United States Patent [19]

Sakurai et al.

[11] 4,145,599

[45] Mar. 20, 1979

[54] FIXING DEVICE OF ELECTROPHOTOGRAPHIC COPYING MACHINE

[75] Inventors: Masaaki Sakurai, Hanno; Masato Ishida, Kawasaki, both of Japan

[73] Assignee: Canon Kabushiki Kaisha, Tokyo, Japan

[21] Appl. No.: 786,811

[22] Filed: Apr. 12, 1977

[30] Foreign Application Priority Data

Apr. 19, 1976 [JP] Japan ..... 51-44775

[51] Int. Cl.[2] ..... G03G 15/20

[52] U.S. Cl. ..... 219/216; 219/388; 219/501; 219/505

[58] Field of Search ..... 219/216, 388, 501, 504, 219/505; 355/3 FU

[56] References Cited

U.S. PATENT DOCUMENTS

| | | | |
|---|---|---|---|
| 3,878,358 | 4/1975 | Barton et al. | 219/216 |
| 4,056,706 | 11/1977 | Strella | 219/216 |

*Primary Examiner*—C. L. Albritton

*Attorney, Agent, or Firm*—Fitzpatrick, Cella, Harper & Scinto

[57] ABSTRACT

The disclosure describes a fixing device for electrophotographic copying machine of the type in which a support carrying thereon a powder image is passed between a pair of rotary members so as to thermally fix the powder image on the support. At least one of said rotary members is heated by a heat source and its surface temperature is controlled by temperature detecting means to maintain it at a predetermined set temperature which is variable in accordance with various conditions of the copying machine, but satisfying a particular temperature relation specified therefor.

9 Claims, 10 Drawing Figures

| FIG. 4A | FIG. 4B |
|---|---|

FIXING DEVICE OF ELECTROPHOTOGRAPHIC COPYING MACHINE

BACKGROUND OF THE INVENTION

The present invention relates to a fixing device in an electrophotographic copying machine (including electrophotographic printing machine) for heat-fixing a powder image carried on a support.

To transfer the heat energy from a heat source to a copying material as well as an unfixed powder image formed thereon, there have been known and used various heating methods. They may be classified into about three types i.e., infrared ray heating, heat plate heating and ribbon heater heating. All of these methods are very poor in thermal efficiency because between the heat generator, heating element and copying material there is more or less interposed some low heat conductive material such as air through which the heat must be supplied. Also these heating methods necessitate relatively large size apparatus.

For these reasons, recently a fixing device has been developed and widely accepted that uses a heat roller having a good thermal efficiency. It is safe in operation and allows the apparatus to be relatively small in size.

In such a heat roller fixing device, it is necessary to prevent the powder image from adhering onto the roller surface. Such an adhesion of powder image to the roller is usually called "offset" and is very troublesome. Furthermore it is necessary to prevent the copying material from being wound around the roller. To this end, the surface of the fixing roller is formed with a layer of special material such as RTV (room temperature vulcanization) silicone rubber. Alternatively the surface is formed with Teflon (ethylene tetrafluoride resin) and a coating of some offset preventing agent such as silicone oil is applied to the roller surface.

The fixing roller is heated by a suitable heat source up to a predetermined temperature which is fairly higher than the temperature level required for giving the minimum quantity of heat to fuse and fix the powder image. To maintain the surface temperature of the fixing roller at the predetermined point, a temperature detecting element continuously detects the surface temperature and in accordance with the detected temperature a control circuit controls the heat source. However there may arise some problem of heat control. When the heat source is powered from a power source, the surface temperature of the fixing roller rises up very rapidly and reaches the predetermined point instantly. But, due to the heat resistance existing between the fixing roller and the detecting element as well as the heat capacity of the detecting element itself, the temperature of the detecting element remains at a point lower than the surface temperature. Because of this time lag, the fixing roller is overheated and its surface temperature exceeds the predetermined point before the detecting element begins controlling the heat source. This phenomenon is called "overshoot". Such an overshoot may cause the oxidation of silicone rubber on the roller surface and/or the emission of smoke. Furthermore there may be caused the problem of creasing and curling of the copy material due to overheating. Also this means a substantial loss of electric power.

Overshoot occurs also in the case of a continuous copying operation at which a number of copy sheets are continuously fixed. In this case, the copy sheets deprive the roller surface of a large quantity of heat and, therefore, the surface temperature drops abruptly. After the completion of one continuous fixing operation, the heat source remains in the ON state until the fixing roller reaches its predetermined temperature. Therefore, the roller surface temperature again rises up abruptly and an overshoot occurs for the same reason as mentioned above. In any case, a stable fixing operation is impossible. This is an important drawback of the conventional fixing device provided with a heat roller.

SUMMARY OF THE INVENTION

Accordingly, it is an object of the present invention to provide a fixing device which eliminates the above described drawbacks involved in the conventional fixing devices.

It is another object of the present invention to provide a fixing device which always assures stable and uniform fixing.

It is another object of the present invention to provide a fixing device which permits fixing with relatively low power consumption and which prevents any power loss.

Other objects and advantages of the invention will become apparent from the following description taken in connection with the accompanying drawings.

DESCRIPTION OF THE PREFERRED EMBODIMENTS

Figure 1:
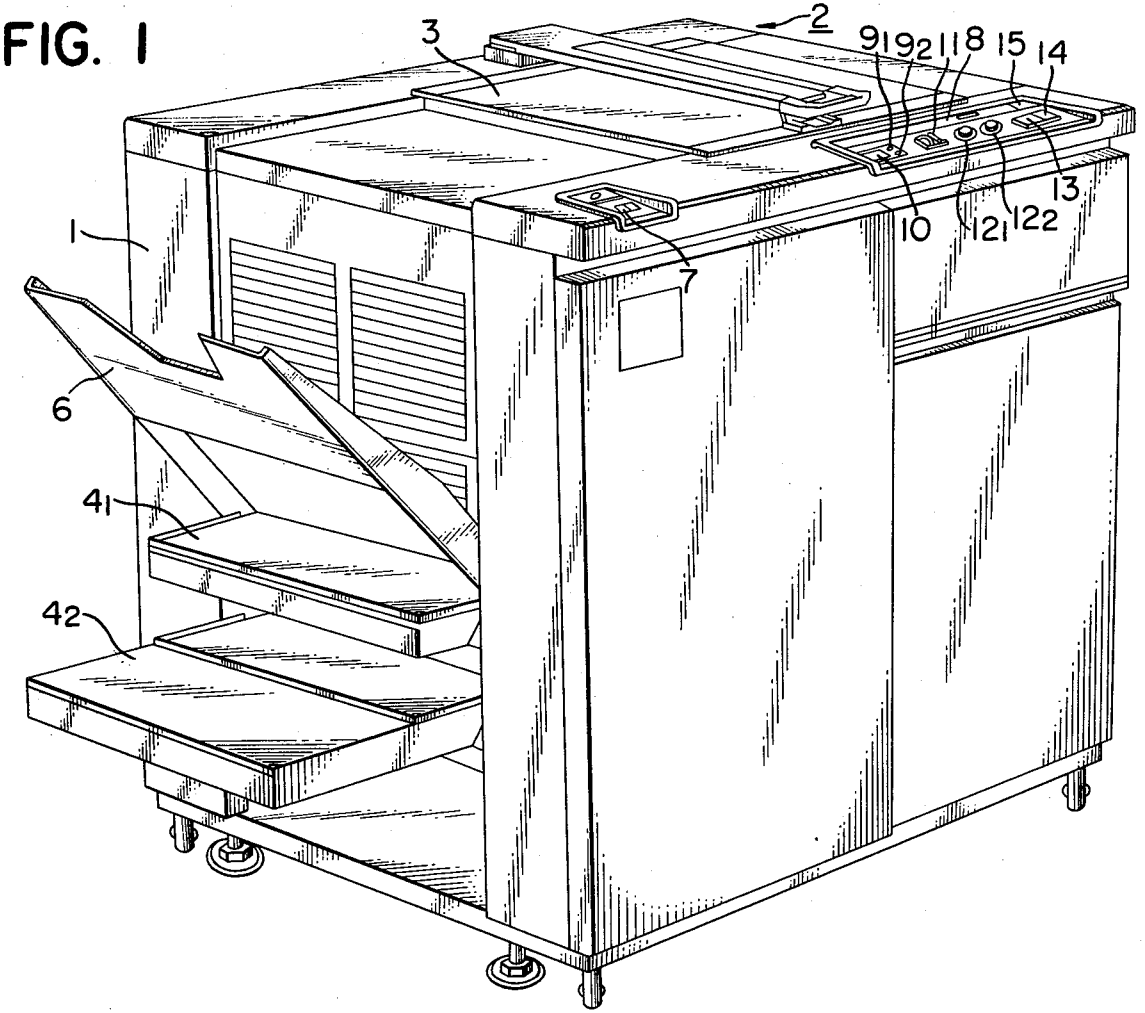
FIG. 1 is a perspective view of an electrophotographic copying machine in which the present invention is embodied.

Referring now to FIG. 1, there is shown a copying machine of the invention having a box like machine casing 1, an original table 2 covered with a cover sheet 3, cassettes $\mathbf{4}_1$ and $\mathbf{4}_2$ for containing transfer sheets $\mathbf{5}_1$ and $\mathbf{5}_2$ which are different in size, and a tray 6 to which a transfer sheet carrying an image transferred thereon is discharged. The copying machine is also provided with a main switch 7, a warning indicator part 8, cassette selector buttons $\mathbf{9}_1$ and $\mathbf{9}_2$, a sheet size indicator 10, a copy density adjusting dial 11, two selector buttons $\mathbf{12}_1$ and $\mathbf{12}_2$ for selecting the number of copies continuously taken, a continuous copy button 13 interlocked with the selector buttons $\mathbf{12}_1$ and $\mathbf{12}_2$, a single copy button 14 that is not with interlocked said selector buttons, and a stop button 15 for cancelling the continuous copy mode. To contain a certain volume of supplemental developer and feed it to the machine as required, there is provided a hopper (not shown) in a room behind the door on the right side as viewed in the drawing.

Figure 2:
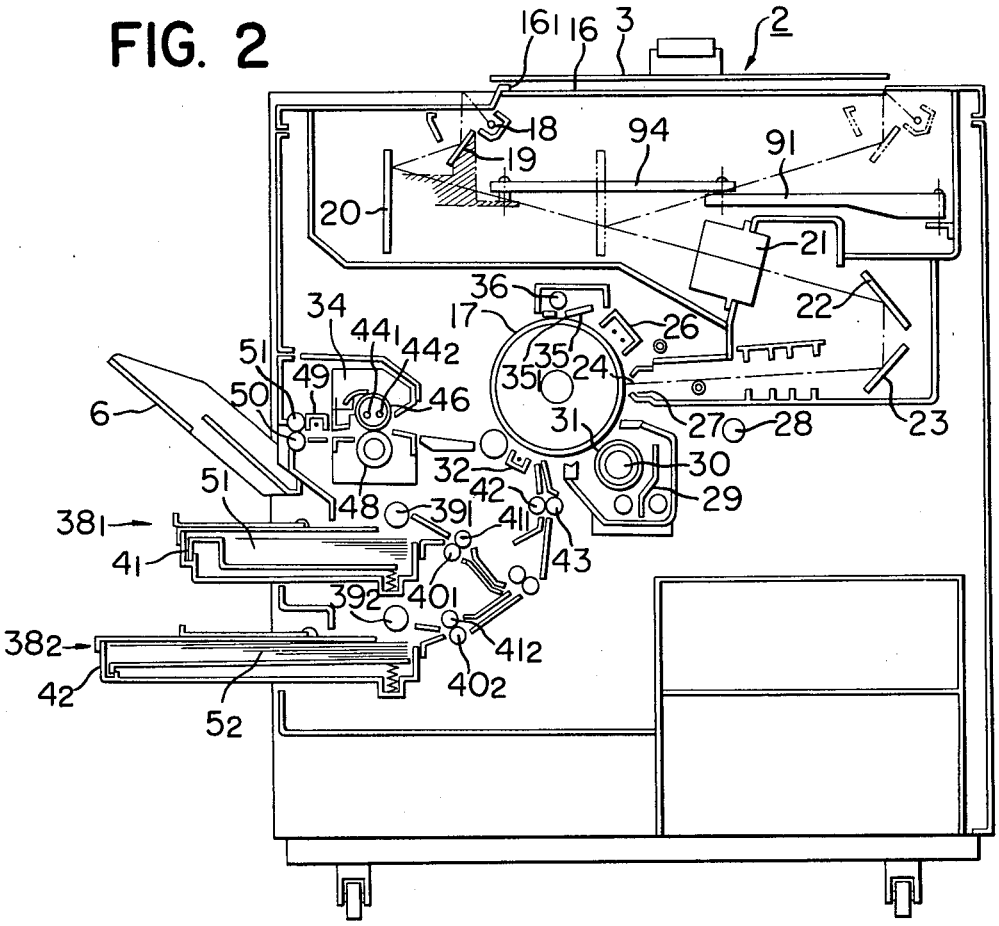
FIG. 2 is a cross-sectional view thereof.

The operation of the copying machine will be explained referring to FIG. 2.

At first, the main switch is turned on so as to supply the necessary power source to the related parts of the machine. Then, an original to be copied is laid on an original supporting plate 16 made of glass with the forward edge of the original being aligned with the forward edge $16_1$ of the glass plate. The original laid on the table is covered with the cover sheet 3. When a wait signal lamp of the warning indicator part 8 becomes off, it is indicated that the copying machine is now ready for the commencement of copying operation. By pushing either the continuous copy button 13 or the single copy button 14, a copy operation signal is produced and the photosensitive drum 17 starts rotating clockwise as viewed in the drawing. As soon as the photosensitive drum has reached a predetermined angular position and an exposure signal has been produced, the moving part of the optical system comprising an illuminating lamp 18 and a first mirror 19 starts moving rightward as viewed in the drawing at the same speed as the peripheral speed of the drum 17. Also a second mirror 20 starts moving rightward, but at a speed corresponding to a half of the peripheral speed of the drum. The lamp 18 illuminates the image of the original from the underside thereof and the image is focused at the exposure part 24 on the drum 17 through the optical system comprising first and second mirrors 19 and 20, a lens 21, third and fourth mirrors 22 and 23. When the exposure is completed, the moving part of the optical system detects the position and stops its rightward movement for reversal. Now it starts moving leftward and returns to its starting position. During returning, it is moved at a higher speed than that during its forward movement for the purpose of speeding-up the copying operation.

When a number of copies are to be continuously taken from one same original, the selector dials $12_1$ and $12_2$ are used to select the desired number of copies and the button 13 is pushed down to start the continuous copying operation. If the single copy button 14 is pushed down to start copying, only one copy may be made irrespective of the number of copies selected by the selector buttons $12_1$ and $12_2$.

The photosensitive drum 17 is composed of three layers i.e., a conductive substrate layer, a photosensitive layer and a transparent dielectric top layer. It rotates clockwise as viewed in the drawing of FIG. 2.

Firstly the drum 17 is charged with positive charge by means of a positive charging device 26 to which a positive high voltage current is supplied from a high voltage power source.

Secondly, at the position of the exposure part 24, the original image as mentioned above is slit-exposed onto the drum 17 which is, simultaneously, subjected to AC charging (charge removing) by means of an AC charging device 27 to which AC high voltage current is supplied from a high voltage power source.

Thirdly the drum 17 is subjected to a full-exposure by the full illumination lamp 28 so as to form a static latent image on the surface of the drum.

The static latent image on the drum is developed by a developing device 29 which comprises a magnet 30 and a sleeve 31 rotating around the magnet and carrying thereon a magnet brush composed of carrier and toner.

The development of the latent image is effected through its contact with the magnet brush. The developed image is transferred to a transfer sheet 5 which is supplied from a transfer sheet feeding part as to closely contact with the photosensitive drum 17. Transferring is effected by means of a transferring charging device 32 with a positive high voltage current from a high voltage power source. The transferring sheet 5 carrying thereon the transferred image is then stripped from the photosensitive drum 17 with a stripping belt holding the one edge of the sheet 5 to direct it to a fixing device 34.

A cleaning blade 35 wipes out the remaining toner on the drum 17 with its contacting edge portion $35_1$ so as to clean up the drum for the next cycle. The wiped toner is placed on the cleaning blade 35 and then removed by a screw 36 to a recovering duct through which the recovered toner is returned to the developing device 29 for reuse.

A stack of the transfer sheets $5_1$ are contained in the cassette $4_1$ whereas a stack of the transfer sheets $5_2$ are contained in the cassette $4_2$. These cassettes $4_1$ and $4_2$ are detachably received in the sheet feeding parts $38_1$ and $38_2$ respectively. To meet various sizes of transfer sheet, a number of such cassettes different in size are prepared and stocked for replacement as required. The cassette selector buttons $9_1$ and $9_2$ are used to selectively supply the transfer sheet from the feeding part $38_1$ and $38_2$. As mentioned above when the photosensitive drum 17 reaches the predetermined angular position and produces a signal for feeding the transfer sheet, either the feeding roller $39_1$ and $39_2$ will shift the transfer sheet $5_1$ or $5_2$ rightward as viewed in the drawing of FIG. 2. The transfer sheet is correctly registered by a first pair of register rollers $40_1$, $41_1$ or $40_2$, $41_2$ with respect to the direction of its movement. Further, a second pair of register rollers 42, 43 are provided to set a timing between the moving transfer sheet and the image on the moving photosensitive drum by means of a timing signal produced by the moving part of the optical system. After so synchronized, the transfer sheet is brought into a close contact with the drum 17 so that the image may be transferred from the drum 17 to the sheet 5 as described above. The transfer sheet in which the image has been transferred is stripped from the drum 17 by means of the stripping belt and then introduced into the fixing device 34.

In the fixing device 34, the transfer sheet is passed through the nip area between a pair of rollers 46 and 48. The roller 46 is a fixing roller heated by the heat sources $44_1$ and $44_2$ and the other roller 48 is a press-contact roller. When the toner image carried on the transfer sheet is passed through between the two rollers, the toner is fused and fixed on the sheet. The transfer sheet 5 leaves the fixing device 34 and the remaining charge on the sheet is removed by the charge removing device 49. Thereafter, the finished sheet is discharged onto the tray 6 by a pair of ejecting rollers 50 and 51.

Figure 3:
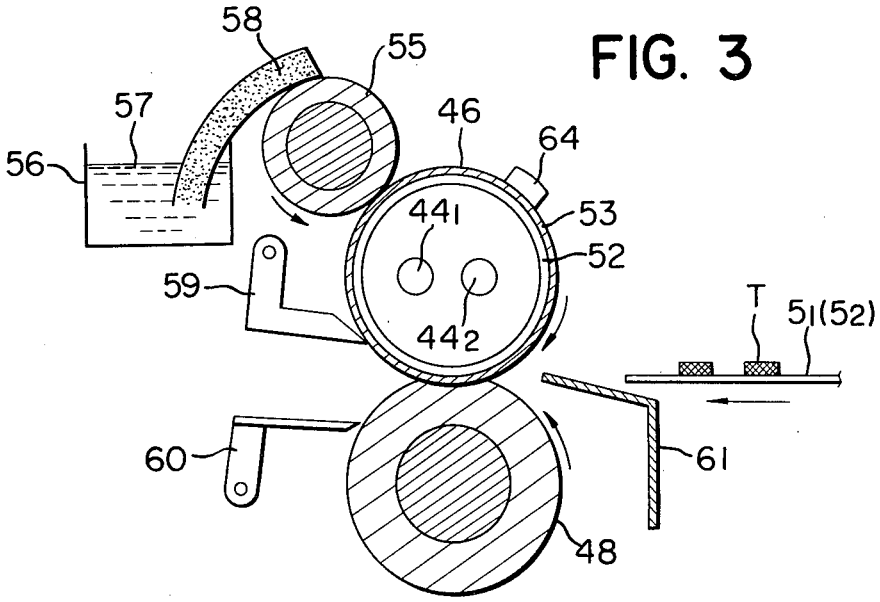
FIG. 3 is a cross-sectional view of the fixing device arranged in the copying machine shown in FIGS. 1 and 2.

As will be seen best from the drawing of FIG. 3 the fixing roller 45 is composed of a hollow metal tube 52 and a thin covering layer 53 on the tube. The tube 52 is made of a metal having a good heat conductivity such as aluminum, copper and the like. The covering layer 53 is formed by a hot vulcanization type of silicone rubber. The thickness of the silicone rubber covering 53 is preferably in the range of 0.2 to 0.7 mm. If a thickness thinner than 0.2 mm is used, the covering will become too poor in durability. On the contrary, a thickness more than 0.7 mm will cause a problem of reduction in heat conductivity to the surface. Namely, it will take too long a time until the surface temperature of the roller reaches the temperature at which copying is possible. Further the roller response is delayed during a continuous copying operation and a stable fixing becomes impossible. Preferably the rubber has a hardness more than 40° to prevent any trouble of creasing.

To obtain a adequate nip width between the press-contact roller 48 and the fixing roller 46, use is made of such hot vulcanization type of silicone rubber that has a hardness of 40°–70° and a thickness more than 5 mm.

Reference numeral 55 designates a coating roller through which an amount of offset preventing liquid 57 is coated onto the fixing roller 46. The coating roller 55 is made of oil-absorptive material such as RTV silicone rubber and heat resisting rubber foam. The offset preventing liquid 57 contained in a reservoir 56 is fed to the coating roller 55 owing to capillary action through a heat resisting felt 58 such as Teflon felt, Nomex felt and the like. Then the coating roller 55 applies it on the fixing roller 46.

The rollers 46 and 48 are maintained spaced from each other whenever fixing is not carried out. When fixing, they are pressed against each other and rotated in the direction indicated by the arrow by means of a conventional driving source (not shown).

To strip the copying material from the rollers after fixing, there are provided a pair of stripper claws 59 and 60 which may be made of heat resisting, mold lubricative resin such as silicone resin and fluororesin. Otherwise each of the stripper claws may be composed of a piece of metal the surface of which is coated with a layer of mold lubricative material such as Teflon. The copying material carrying thereon a toner image T is introduced into the fixing device 34 along an entrance guide 61. The heat sources $44_1$ and $44_2$, which are usually halogen lamps or infrared lamps, heat the fixing roller 46 from the inside so that the surface temperature of the roller 46 may be maintained at a point higher than the fusing temperature of the toner.

To adjust the surface temperature to a predetermined temperature, there is provided a temperature detecting element such as a thermistor 64 which is contacted with the surface of the fixing roller 46 and also connected with the heat sources $44_1$ and $44_2$ through a temperature control circuit.

It has been found that in view of fixing efficiency the best result can be obtained when a hot vulcanization type of silicone rubber having a thickness of 0.3 mm and a hardness in the range of 40°–70° is used for the fixing roller and the same type of silicone rubber having a thickness in the range of 9–10 mm and a hardness in the range of 30°–50° is used for the press-contacting roller. In one experiment where a hot vulcanization type of silicone rubber of 40 $\phi$ outer-diameter and 0.3 mm thick (available as KE-540, KE-860, KE-870, etc. from SHINETSU Chemicals Co. Ltd., Japan) was used for the fixing roller 46 and that of 40 $\phi$ outer-diameter and 9 mm thick (SHINETSU Chemicals, KE-530, KE-540, etc.) for the press-contact roller 48, a solid black image carried on the copying material as mentioned above was fixed under the conditions of the fixing roller surface temp. = 130° C., the press-contact roller surface temp. = 20° C. and the nip retention time = 0.048 sec. The nip retention time is a time during which the image is present at the nip between the two rollers (nip width roller peripheral speed = heating time). In contrast, when a roller having a 10–60$\mu$ thick Teflon covering was used for the fixing roller, a higher surface temperature of the fixing roller, namely 165° C. was required to completely fix the same solid black image at the same heating time of 0.048 sec. This means that the latter roller is substantially inferior to the former in terms of thermal efficiency. Therefore it will be understood that by forming the surface of roller from silicone rubber, a substantial energy saving is attainable compared with Teflon.

The temperature detecting element is constructed in such a manner that its set temperature is variable in accordance with various conditions of the copying machine. For the purpose of this specification the term "set temperature" means a predetermined temperature so set for the detecting element 64 that when the detected temperature is lower than said predetermined temperature, the heat source is turned ON and when the detected temperature is higher than it, the heat source is turned OFF.

According to the invention, the set temperature is so varied as to satisfy the following formula $$T_{WA} \leqq T_{ME} < T_{st} < T_{CO}$$

wherein, $T_{WA}$ is a set temperature for "wait time", $T_{st}$ is a set temperature for "stand-by time", $T_{CO}$ is a set temperature for "copy making time", and $T_{ME}$ is a set temperature for a given time period after a continuous copying operation.

In the above definition, "wait time" is a time period which is required for the copying machine to attain the condition ready for copying after the commencement of supplying the source power to the machine. If $T_o$ is defined as a temperature required for giving the minimum quantity of heat necessary to fuse and fix the powder image, "condition ready for copying" will correspond to a condition under which the fixing roller has been heated to a temperature higher than the minimum temperature $T_o$. "Stand-by time" is a time period during which no copying operation is effected although the copying machine has already attained the condition ready for copying. "Copy making time" is a time at which a copying operation is being effected.

Figures 4, 4A:
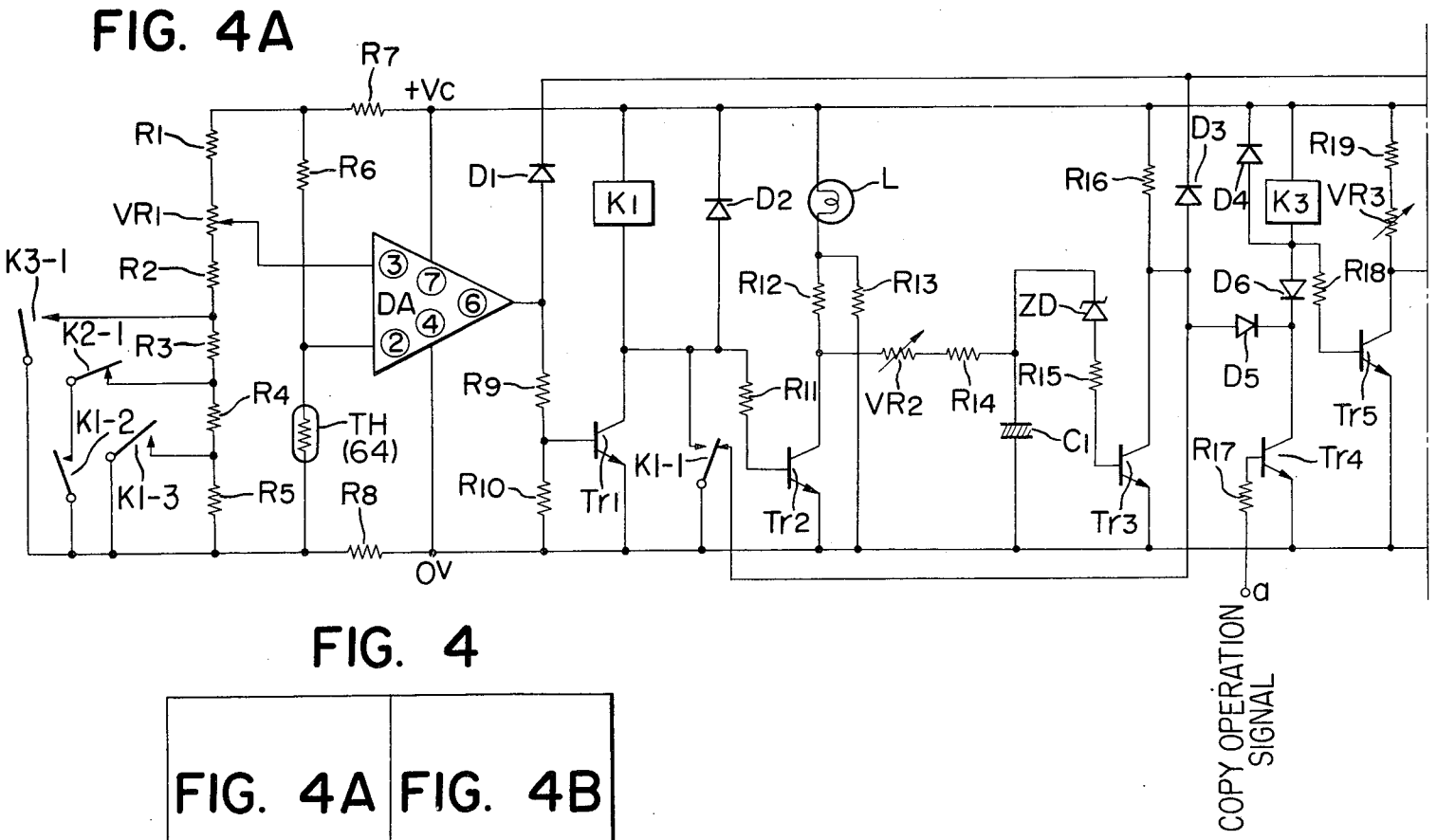
FIG. 4 shows the relative positions between FIGS. 4*a* and 4*b*.
FIGS. 4*a* and 4*b* show a temperature control circuit.
Figure 4B:
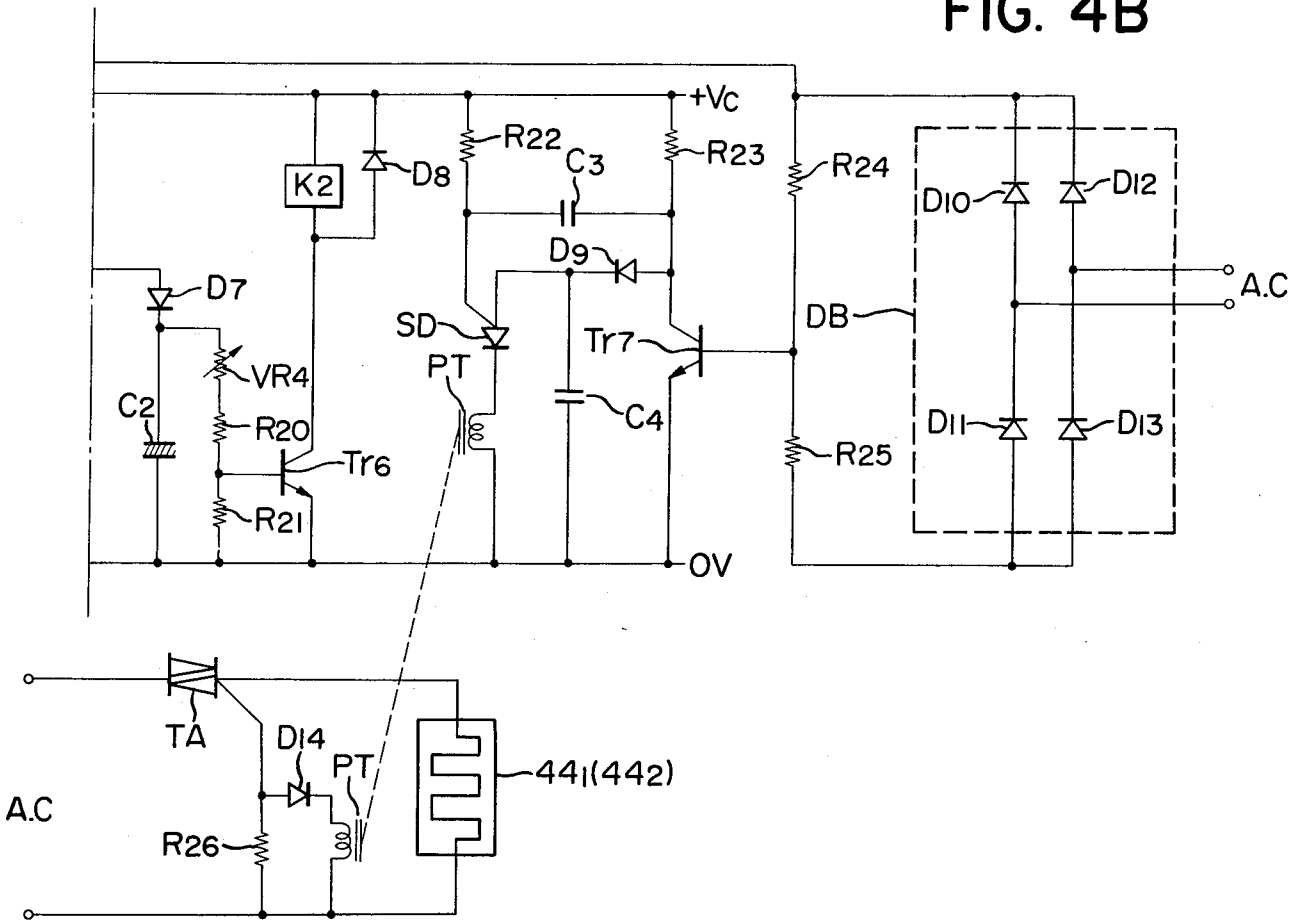

FIG. 4 shows an example of the temperature control circuit in which a thermistor TH is used as the temperature detecting element 64.

In the circuit shown in FIG. 4, the thermistor TH together with a series of resistances R1 through R6 and a variable resistance VR1 form a bridge circuit to which a voltage is applied from a DC power source $V_C$ through resistances R7 and R8. It operates in such a manner that the resistance value may be varied in accordance with the change in temperature and thereby the deviation of voltage value on each of the resistances VR1 and R1 through R5 constituting the bridge circuit may be varied accordingly. The reference character DA designates a differential amplifier having power source input terminals ④ and ⑦, signal input terminals ② and ③ for detecting above-mentioned deviation of the voltage value, and deviation signal output terminal ⑥. The output signal produced from the terminal ⑥ is selectively applied to the base of a transistor Tr7 through a diode D1. The reference character DB designates a full-wave rectifier circuit composed of a bridge circuit of diodes D10 through D13. The circuit DB receives on AC output and puts out a full-wave rectified wave. The output is applied to the base of the transistor Tr7 through a resistance R24.

The heat sources $44_1$ ($44_2$) are powered by an alternating current power source AC through the main switch 7 of the copying machine. To effect the switching, a TRIAC- TA (General Electric Company) is used.

If the surface temperature of the fixing roller heated by the heat sources $44_1$ ($44_2$) is in the lower range of temperature, then the resistance value of the thermistor TH will increase and, therefore, the voltage at the input terminal ② of the differential amplifier will also increase. As a result, the output from the terminal ⑥ will decrease and, to the base of the transistor Tr7, there will be applied, as a base voltage, the full-wave rectified wave, that is, the output from the diode-bridge DB. Accordingly, the collector voltage of said transistor Tr7 will take a pulse shape which is produced every half cycle of the power source AC since when the base voltage is higher than its threshold level, said transistor Tr7 becomes ON and when the base voltage is lower than the threshold level, it becomes OFF. Also, when the transistor Tr7 is OFF, its collector voltage is at a high level. Therefore, the capacitor C4 is charged through the resistance R23 as well as the diode D9 and, at the same time, its voltage is applied to the positive side of the switching element SD. However, since a high voltage substantially equal to that on the positive side is applied to the gate of the switching element SD through a resistance R33, said switching element SD becomes OFF. After that if the transistor Tr7 is turned on, then an electric current will flow through the resistance R23 and the collector voltage of the transistor Tr7 will drop to a lower level. As a result, there will be produced a charge current flowing into the capacitor C3 through the resistance R22, which in turn will cause a temporary drop in the gate potential of the switching element SD. Therefore, the switching element SD becomes ON and the charge stored in the capacitor C4 is discharged through the switching element SD and the winding of the pulse transformer PT. Accordingly, on the winding, there is induced a pulse voltage which is produced every half cycle of the power source AC.

From the foregoing it will be understood that when the surface temperature of the fixing roller is low, a pulse voltage is induced in the winding of the pulse transformer PT every half cycle of the alternating current source AC. Therefore, to the gate of the TRIAC-TA, a pulse trigger is applied every half cycle of the source AC and, to the heat sources $44_1$ ($44_2$), a power of nearly whole cycle is applied. As a result, the surface temperature is raised. At the same time, the transistor Tr1 turns on and the transistor Tr2 turns off, and the wait lamp L of the warning indicator part 8 continues lighting until the thermistor temperature reaches the set point. At the time, the relays K1, K2 and K3 are Off and the contacts K1-3, K1-2 and K3-1 of the relays K1 and K3 are opened. Therefore, the temperature determined by the resistances R1 through R8 and the variable resistance VR1 will be set to the lower most temperature $T_{WA}$ (refer to FIG. 6). This set temperature $T_{WA}$ is preferably so selected that the maximum surface temperature of the roller for "wait time" (corresponds to T4 in FIG. 5 as explained later) may be a little higher than the set temperature Tst for "stand-by time". Most preferably a temperature 5°–15° higher than the set temperature Tst is selected for it. This is because the atmospheric temperature of the fixing roller immediately after a wait time is still low and therefore if copying is carried out immediately after a wait time, a larger drop in surface temperature of the fixing roller is caused compared with copying during a "stand-by time". The presence of an overshoot by some 5°–15° C. will prevent such a large drop in the surface temperature.

During the wait time, the surface temperature of the fixing roller rises up rapidly and the resistance value of the thermistor TH decreases accordingly. When the thermistor temperature has exceeded the set temperature $T_{WA}$, the voltage at the input terminal ② of the differential amplifier DA becomes low and the output from its terminal ⑥ becomes high. Therefore, to the base of the transistor Tr7, there are applied not only the full-wave rectified wave but also the output of the amplifier DA. This means that a voltage higher than the threshold is applied to the transistor Tr7.

Figure 6:
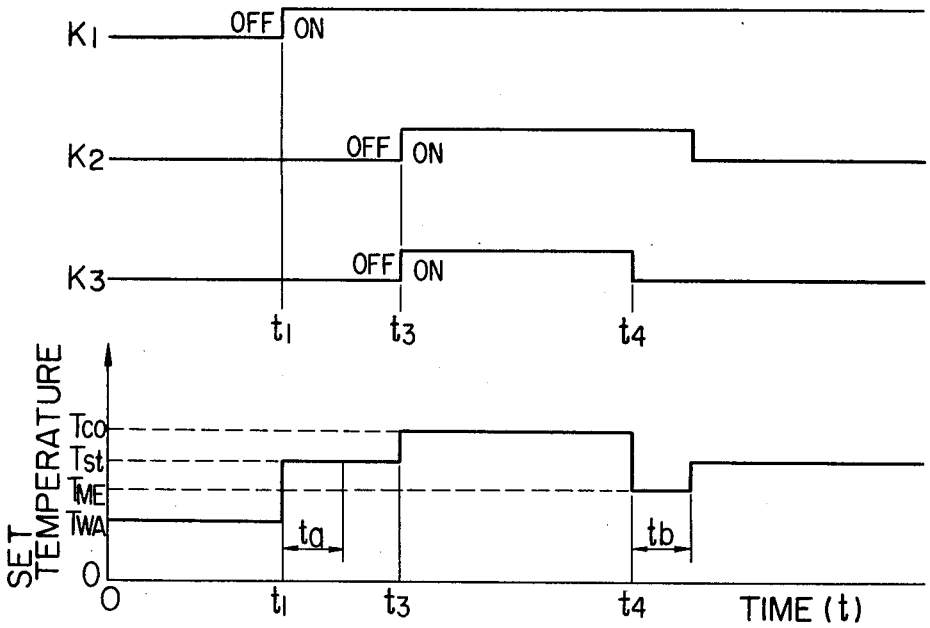
FIG. 6 is a time chart of set temperature switching.

As a result, Tr7 remains constantly at the state of On and also its collector voltage remains at the lower level. Thereby, the pulse voltage induced in the winding of the pulse transformer PT is lost. This causes the heat sources $44_1$ ($44_2$) to turn off. At this point of time, the set temperature determined by the resistances R1 through R5, the variable resistance VR1 and the contacts of the relays K1 through K3 changes up to a set temperature Tst that is higher than $T_{WA}$ by turning the relay K1 on through turning on of the transistor Tr1 (see FIG. 6, at this time, the transistor Tr2 is the turned on and the wait lamp L is put off, so that the copying machine is now ready for copying and comes into "stand-by" condition) so as to close the contacts K1-2 and K1-3. The change in the set temperature from $T_{WA}$ to Tst brings forth the corresponding change in the output of the amplifier DA from low level to high. But, the heat sources $44_1$ ($44_2$) can still remain Off for a delay time ta determined by a timer composed of resistances R13, R14, variable resistance VR2, capacitor C1 and zener diode 2D. After the timer time ta has elapsed, the temperature control is effected at the level of the set temperature Tst (FIG. 6). When either copying button 14 or 13 is pushed in this state of the copying machine, a copying operation is started and the machine takes its condition of "copy making". At the same time, a copy operation signal (fixing instruction) is given to the base of the transistor Tr4 and the relay K3 is turned on. This closes the contact K3-1 so that the set temperature is changed over from Tst to a higher set temperature $T_{CO}$ (FIG. 6). It is preferable to select the set temperature as to satisfy the relation of $10 \geqq T_{CO} - Tst \geqq 5$.

When the copying operation is completed by discharging the copy sheet into the tray 6, the relay K3 is again turned off and its contact K3-1 is opened. However, the relay K2 can remain still On for a delay time tb determined by a timer composed of resistances R18, R19 and variable resistance VR4 and capacitor C2 and, therefore, its contact K2-1 is kept open so that the set temperature is turned over from $T_{CO}$ to $T_{ME}$ (FIG. 6). The timer time tb varies in accordance with the number of copies continuously taken, for example, in the range of from 5 to 60 sec.

Figure 7:
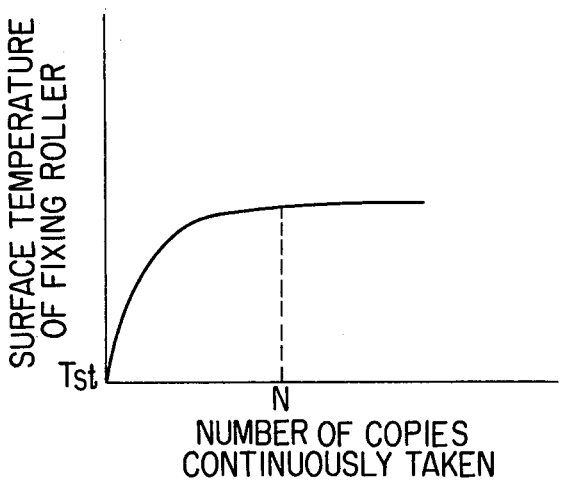
FIG. 7 shows a correlation curve between the surface temperature of the fixing roller and the number of copies continuously taken.
Figure 8:
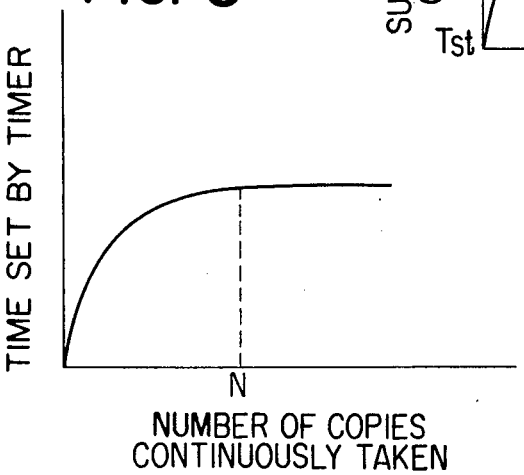
FIG. 8 shows a correlation curve between time set by timer and the number of copies continuously taken.

After the completion of one continuous copying operation, there occurs some delay of the response of the thermistor. Therefore, when the set temperature is Tst, the overshoot of the surface temperature of the fixing roller cannot to kept constant so far as the number of copies is smaller than a certain number N as seen from FIG. 7. To eliminate this drawback, in the above described embodiment, a timer circuit is formed by resistances R19, R20, R21, VR3, VR4 and capacitor C2 so that the charge voltage on the capacitor C2 may be changed in accordance with the output time of the copy operation signal (the signal is continuously put out in a continuous copying operation). By this arrangement, the timer time tb is varied in accordance with the number of copies continuously taken, as shown in FIG. 8. In this connection, the variable resistace VR4 may be interlocked with the selector dials $12_1$, $12_2$. After the time tb, the relay K2 is again turned off and the set temperature is returned to Tst for "stand-by". This temperature control system is effective in particular for the case where the fixing roller is internally heated and has a low heat conductive covering the thickness of which is over 0.1 mm. But, the invention is also effective for another case wherein the fixing roller is externally heated.

Figure 5:
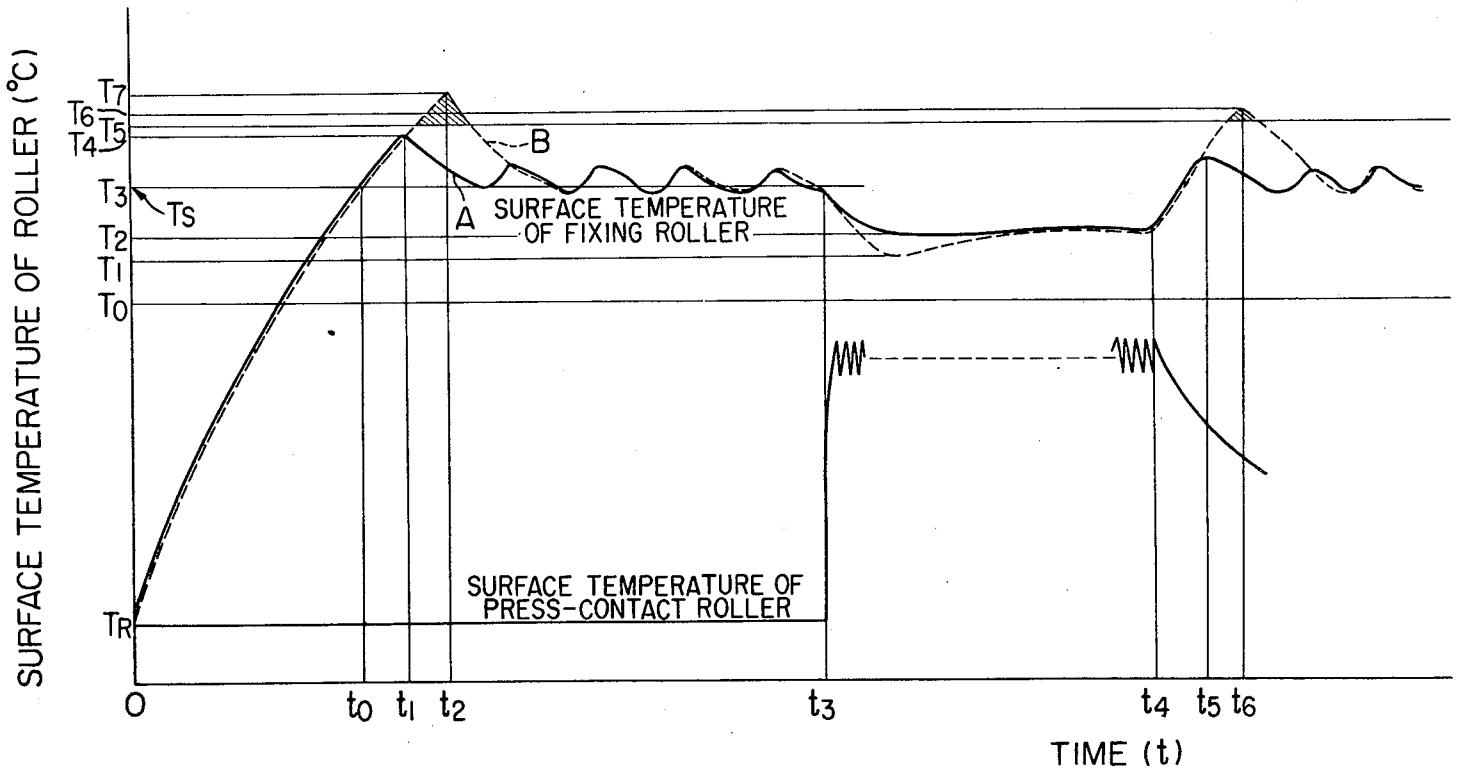
FIG. 5 shows curves of roller surface temperature.

FIG. 5 shows a curve of the roller surface temperature according to the temperature control system of the invention compared with that of the conventional control system.

The solid line curve A is a curve of the surface temperature of a fixing roller according to the invention and the broken line curve B is that of the conventional system in which the thermistor set temperature is Ts.

The point To on the ordinate is the minimum surface temperature of the fixing roller at which fixing is possible. At any temperature lower than To, there occurs some low temperature offset. The point T5 is the maximum surface temperature. At a higher temperature than T5, there will occur the emission of smoke due to oxidation and/or evaporation of low molecular weight rubber and/or offset preventing liquid on the source-and inner portions of the fixing roller. Therefore, the range of temperature which enables good fixing exists between $T_0$ and T5. $T_0$ may be varied in accordance with the physical properties of the toner employed whereas T5 may be varied in accordance with the type and quality of surface material of the roller used. In other words, different toners and different surface materials give different $T_0$ and T5.

When the power source is applied to the heat source, the surface temperature rises up rapidly.

The curve B for the conventional system indicates that the surface temperature reaches the set temperature Ts after the time to. But, the thermistor temperature is still lower than Ts due to the heat resistance existing between the roller and the thermistor as well as the heat capacity of the thermistor. Therefore, the heat source still remains in the state of ON. The thermistor does not reach Ts until the surface temperature reaches T7 (time t2). Then the heat source becomes OFF and the surface temperature begins descending and, thereafter, the temperature control starts around the set temperature. Further it will be seen that the temperature of the press-contact roller remains unchanged at about room temperature $T_R$.

At the time t3, copying is started and the two rollers are driven. The contact of the press-contact roller with the fixing roller and the passing through of the copy sheet between the two rollers deprives the fixing roller surface of some quantity of heat. Therefore, the surface temperature of the fixing roller drops abruptly. Due to a time lag to the thermistor, the response of the heat source to this rapid drop in surface temperature is somewhat delayed. As a result, the surface temperature of the fixing roller continues dropping further to T1. On the contrary, the surface temperature of the press-contact roller rises up very rapidly from the room temperature to a very high level as shown in FIG. 5. The continuous copying operation is completed at the time t4 and the rollers are stopped. The surface temperature of the fixing roller begins rising again. When its temperature reaches T6 that is higher than the set temperature Ts, the thermistor temperature reaches Ts and the heat source is turned off. Then the surface temperature drops to Ts and the temperature control is started at this level.

The hatched area in the curve B is a range of temperature at which there occurs smoke emission due to excess of over-shoot and the practical use of the copying machine becomes troublesome.

According to the invention, the set temperature is variable in accordance with various operational conditions of the copying machine so that the change in temperature on the fixing roller surface is limited to a narrow range. Therefore the present invention ensures a stable fixing operation under optimum temperature conditions.

In the above described embodiment of the invention, the surface temperature of the fixing roller describes the curve A of FIG. 5.

The set temperature $T_{WA}$ is selected in such a manner that the peak of overshoot (T4 in FIG. 5) may be a little higher than the set temperature Tst. This prevents any excess over-shoot.

Furthermore, for the set temperature $T_{CO}$, such a temperature is selected that is higher than the set temperature Tst. By doing so, the temperature drop on the surface of the fixing roller can be reduced to a minimum, because an instant turning on of the heat source is possible during copy making.

Lastly, the set temperature $T_{ME}$ for a given time period after a continuous copying operation is so selected that it may be lower than the set temperature Tst. This prevents any overshoot after the completion of a continuous copying operation. But it should be noted that the overshoot occurring immediately after a continuous copying operation is relatively small compared with that after "wait time" and, therefore, the set temperature $T_{ME}$ is not always necessary.

The temperature control being made in the manner described above, the maximum temperature T4 and the minimum T2 satisfy the relation of: $T_O < T2 < T4 < T5$.

Therefore it will be understood that according to the invention, the surface temperature of the fixing roller is kept in the range of temperature at which a good fixing operation is always possible, with the exception of "wait time".

While the invention has been particularly shown and described with reference to preferred embodiments thereof, it will be understood by those skilled in the art that the foregoing and other changes in form and details can be made therein without departing from the spirit and scope of the invention.

What we claim is:

1. A fixing device for a copying machine, comprising:

a heating member adapted to be contacted with a member bearing an image to be fixed;

a heating source, supplied with electric power, for heating said heating member; and control means for allowing electric power supply to said heating source to heat said heating member, wherein said control means stops the electric power supply when the heating member is heated to a first fixing temperature, allows resumption of the electric power supply a predetermined time after stopping the electric power supply in order to maintain the temperature of said heating member at a second fixing temperature higher than said first fixing temperature and maintains the temperature of the heating member at a third fixing temperature higher than said second fixing temperature when said copying machine is operated to provide a copy.

2. A device according to claim 1, wherein the temperature of the heating member is maintained at a fourth temperature higher than said first temperature but lower than said second temperature, after said copy machine continuously provides a plurality of copies.

3. A device according to claim 2, wherein, after the temperature of the heating member is maintained at said fourth temperature for a predetermined time, it is controlled to be maintained at said third temperature.

4. A device according to claim 3, wherein said fourth temperature is changeable in accordance with the number of copies continuously produced.

5. A fixing device for a copying machine comprising:

a pair of rollers press-contacted to each other;

a heating source for heating at least one of said rollers;

detecting means for detecting the temperature of said at least one roller;

control means for controlling said heating source to maintain a set temperature of said at least one roller, said control means including means for changing the set temperature to satisfy the following relation;

$$T_{WA} \leqq T_{ME} < Tst$$

where $T_{WA}$ is a set temperature during the waiting time from when heating is begun until a sufficient temperature for fixing is achieved, Tst is a set temperature during stand-by when a sufficient fixing temperature has been achieved but no copying is being performed, and $T_{ME}$ is a set temperature after a plurality of copy images have been continuously fixed by said fixing means.

6. A fixing device for a copying machine comprising:

a heating member for fusing and fixing a toner particle image onto copy paper;

a heat source for heating said heating member;

means for controlling said heat source in response to the temperature of said heating member to maintain said heating member at a desired temperature, said controlling means including detecting means for detecting the temperature of said heating member, a first temperature control means for maintaining said heating member at a first temperature, a second temperature control means for maintaining said heating member at a second temperature higher than said first temperature, and means for selectively connecting one of said first, second and a third temperature control means for maintaining said heating member at a third temperature higher than said second temperature, and means for selectively connecting one of said first, second and third temperature control means with said detecting means and said heat source in accordance with the operating condition of said copy machine.

7. A device according to claim 6, wherein said selecting means selects the first temperature control means in response to the inoperable condition of said copy machine, the second temperature control means in response to the operable condition of said copy machine, and the third temperature control means in response to the start of operation of said copying machine.

8. A device according to claim 7, wherein said control means further includes fourth temperature control means for maintaining said heating means at a fourth temperature higher than said first temperature but lower than said second temperature, and said selecting means selects said fourth temperature control means after the copying machine is operated continuously to provide a plurality of copies.

9. A device according to claim 6, wherein said heating member is a roller having a surface of silicone rubber.

* * * * *

UNITED STATES PATENT OFFICE
CERTIFICATE OF CORRECTION

Patent No. 4,145,599 Dated March 20, 1979

Inventor(s) MASAAKI SAKURAI, ET AL

It is certified that error appears in the above-identified patent and that said Letters Patent are hereby corrected as shown below:

Column 4, line 21, "and" should read --or--;

Column 4, line 25, "and" should read --or--;

Column 8, line 22, "is the turned on" should read --is turned on--;

Claim 6, column 11, line 36 to column 12, line 19, should read:

--A fixing device for a copying machine comprising:
a heating member for fusing and fixing a toner particle image onto copy paper;
a heat source for heating said heating member;
means for controlling said heat source in response to the temperature of said heating member to maintain said heating member at a desired temperature, said controlling means including detecting means for detecting the temperature of said heating member, a first temperature control means for maintaining said heating member at a first temperature, a second temperature control means for maintaining said heating

UNITED STATES PATENT OFFICE

CERTIFICATE OF CORRECTION

Patent No. 4,145,599 Dated March 20, 1979

Inventor(s) MASAAKI SAKURAI, ET AL

It is certified that error appears in the above-identified patent and that said Letters Patent are hereby corrected as shown below:

member at a second temperature higher than said first temperature, a third temperature control means for maintaining said heating member at a third temperature higher than said second temperature, and means for selectively connecting one of said first, second and third temperature control means with said detecting means and said heat source in accordance with the operating condition of said copy machine.--

Signed and Sealed this

*Eleventh* Day of *December 1979*

[SEAL]

*Attest:*

SIDNEY A. DIAMOND

*Attesting Officer*

*Commissioner of Patents and Trademarks*